US006802472B2

(12) United States Patent
Henry et al.

(10) Patent No.: US 6,802,472 B2
(45) Date of Patent: Oct. 12, 2004

(54) WINDING MACHINE TRANSFORMABLE ONSITE

(75) Inventors: Pierre Henry, Pfastatt (FR); Michel Mazoyer, Pfastatt (FR)

(73) Assignee: Superba, Mulhouse (FR)

( * ) Notice: Subject to any disclaimer, the term of this patent is extended or adjusted under 35 U.S.C. 154(b) by 0 days.

(21) Appl. No.: 10/238,682

(22) Filed: Sep. 11, 2002

(65) Prior Publication Data

US 2003/0052214 A1 Mar. 20, 2003

Related U.S. Application Data

(60) Provisional application No. 60/324,099, filed on Sep. 24, 2001.

(30) Foreign Application Priority Data

Sep. 17, 2001 (FR) ..... 01 12012

(51) Int. Cl.[7] ..... B65H 54/40
(52) U.S. Cl. ..... 242/484.6
(58) Field of Search ..... 242/484.6, 470, 242/473.5, 472.6

(56) References Cited

U.S. PATENT DOCUMENTS

| | | | | | |
|---|---|---|---|---|---|
| 2,536,510 | A | * | 1/1951 | McGuire | 242/470 |
| 3,219,171 | A | * | 11/1965 | Finger | 242/470 |
| 3,345,813 | A | * | 10/1967 | Long | 242/472.6 |
| 3,380,238 | A | * | 4/1968 | Araki et al. | 242/472.6 |
| 4,062,503 | A | | 12/1977 | Chaplin, Jr. et al. | |
| 4,865,260 | A | * | 9/1989 | Colli et al. | 242/473.6 |
| 5,016,434 | A | * | 5/1991 | Kamp | 242/473.5 |
| 5,033,686 | A | | 7/1991 | Rebsamen | |
| 5,222,350 | A | * | 6/1993 | Bowman et al. | 57/267 |
| 5,431,006 | A | * | 7/1995 | Schuller et al. | 57/406 |
| 5,495,991 | A | * | 3/1996 | Raasch et al. | 242/473.6 |
| 5,634,603 | A | * | 6/1997 | Raasch et al. | 242/473.6 |
| 6,328,247 | B1 | * | 12/2001 | Fechter et al. | 242/473.6 |

FOREIGN PATENT DOCUMENTS

| | | |
|---|---|---|
| DE | 41 25 310 | 2/1992 |
| DE | 199 21 630 | 11/2000 |
| FR | 2.098.134 | 3/1972 |
| FR | 2.202.511 | 5/1974 |
| GB | 2 137 669 | 10/1984 |

* cited by examiner

*Primary Examiner*—William A. Rivera
(74) *Attorney, Agent, or Firm*—Young & Thompson

(57) ABSTRACT

A winding machine, essentially constituted by individual winding stations disposed in stages which are controlled, at the level of each stage, by an assembly of drive shafts of packages and drive shafts of fliers, the yarns being supplied by a pre-feed device for its yarns. The winding machine is transformable on site and has a device for operating the drive elements of the drive shafts of the packages, the drive shafts of the fliers, and of the pre-feed device, the yarns being possibly mounted as desired in an interchangeable manner at the two ends of the winding machine, by symmetrical end plates or flanges, with arrangement in the front, of the conveyor which passes through them.

6 Claims, 2 Drawing Sheets

WINDING MACHINE TRANSFORMABLE ONSITE

This application claims the benefit of U.S. Provisional Application No. 60/324,099, filed Sep. 24, 2001.

FIELD OF THE INVENTION

The present invention relates to the field of the textile industry, in particular machines for winding yarns and especially synchronous winding machines and has for its object such a winding machine transformable on site.

BACKGROUND OF THE INVENTION

At present, the known synchronous winding machines are generally of a type comprising a certain number of spindles, for example 24 spindles, and extensible to 36 or 48 spindles and are always supplied at one of their ends, the packages being supplied with yarns individually, by a vertical station with arrival of the yarn from the side opposite that of winding and evacuation of the packages is always carried out from the side opposite that of arrival of the yarn toward a conveyor. Moreover, there exist winding machines whose supply of yarns is carried out from the front.

These known machines however have a relatively great width dimension, undesirable for an economic installation in a factory, because they require a large area of floor space. Moreover, these machines cannot be mounted back to back with a reduced width of installation, which is to say such that they can be overseen in opposite rows of two by a same operator.

To this end, it has been proposed to provide specific machines for left-hand service and right-hand service. However, even in the case of the use of such right and left-hand machines, a back-to-back arrangement remains impossible, because of the fact of supplying the yarn from the rear portion of the machines with vertical return from the frontal side of the machine.

Moreover, in these known machines, removal of the packages at the output of the winding stations by means of a conveyor, must always be carried out in a same direction, namely, from the side of the machine opposite that comprising the control panel with the operating device for the shafts of the packages, drive shafts of the fliers and the driving of the pre-feed device.

It is thus necessary, in the case in which a modification of arrival of the yarns supplying the winding machine or of the device for removing full packages is desired, to carry out a rotation of 180° of the machine on its base, which is generally impossible given the length of the latter and a modification of the machines being impossible. As a result, either such modifications are not at present possible, or they require the installation of complementary transfer devices from one end of the machine to the other, generally by an aerial route. Such installations necessarily give rise to correspondingly high costs.

Finally, the operation of these machines is carried out by means of a single one or two drive motors acting, either, in the first case, on the shafts of the packages and for driving the fliers and on the drive of the pre-feed device, or, in the second case, on the one hand, on the drive shafts of packages and the drive of the fliers and, on the other hand, on the pre-feed device. These motors are connected to the corresponding shafts by means of mechanical transmission elements such as assemblies of pulleys and notched belts or else gearing.

Generally speaking, when the drive of the shafts of the packages and the fliers is carried out by a specific motor, the drive of the fliers is carried out with interposition of a device for vobulation or mechanical interference. Such a vobulation device is adapted to carry out a rough winding avoiding the formation of ribbons which would be undesirable during unwinding of the packages.

Moreover, because of the multiple return runs necessary between the pulleys and the transmission belts or the numerous gearing to be interposed between the motors and the drive shafts for packages and for driving the fliers, the size of the operating assembly of the synchronous winding machines known at present is relatively great. Moreover, because of the number of intermediate elements, the maintenance of the machine thus provided is more complicated.

SUMMARY OF THE INVENTION

The present invention has for its object to overcome these drawbacks by providing a winding machine transformable on site, permitting not only an extension in length, but also a modification of its use characteristics, namely, with removal of the packages to the right or to the left and operation from one or the other of its ends.

To this end, the winding machine according to the invention is characterized in that it is transformable on site and in that it has an operating device for the drive means for the packages, the fliers and the pre-feed device for the yarns, assemble able in various ways as desired, interchangeably, at its two ends, by means of plates or symmetrical end flanges, with arrangement in front of the conveyor which passes through it.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE INVENTION

Figure 1:
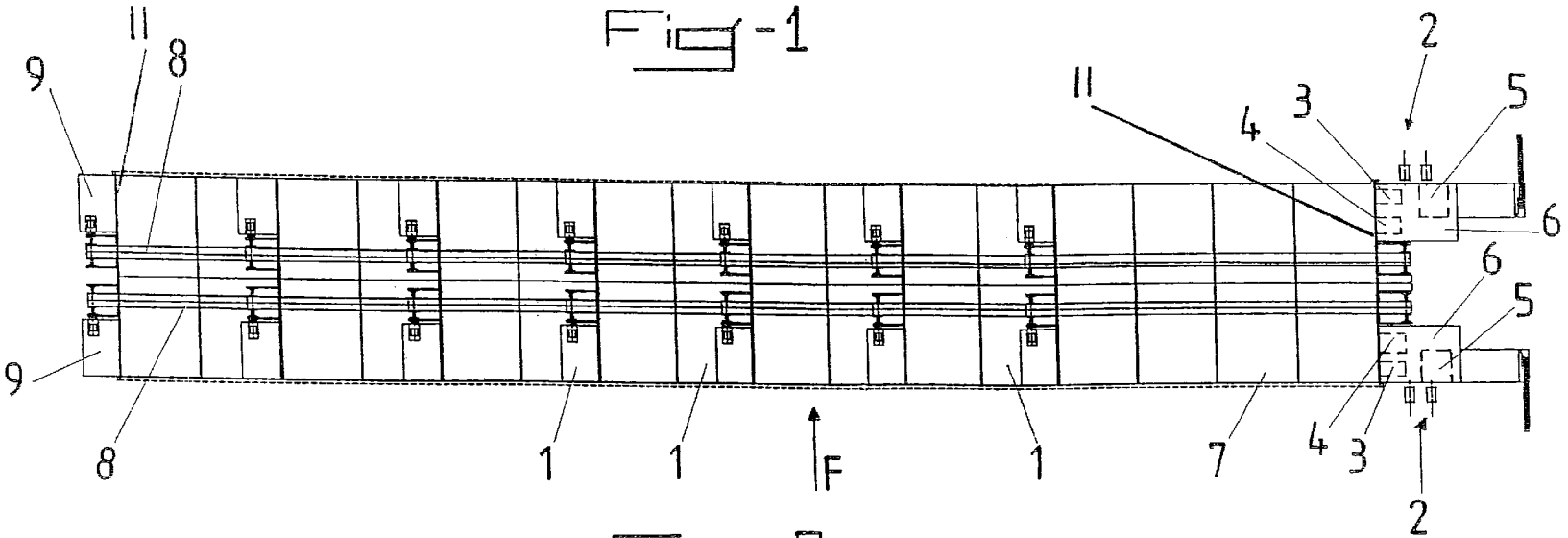
FIG. 1 is a plan view showing two winding machines according to the invention mounted back-to-back.
Figure 2:
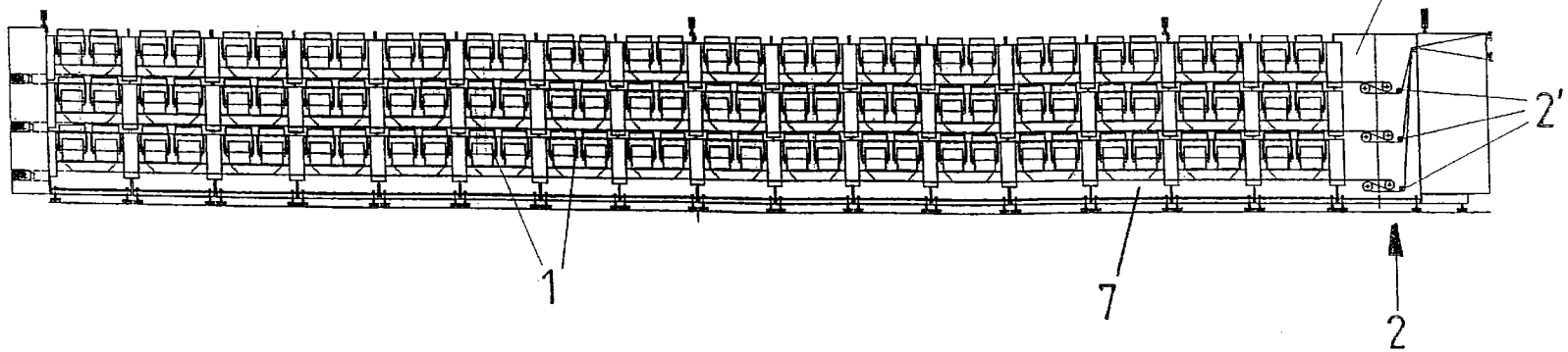
FIG. 2 is a side elevational view seen in the direction F in FIG. 1.
Figure 3:
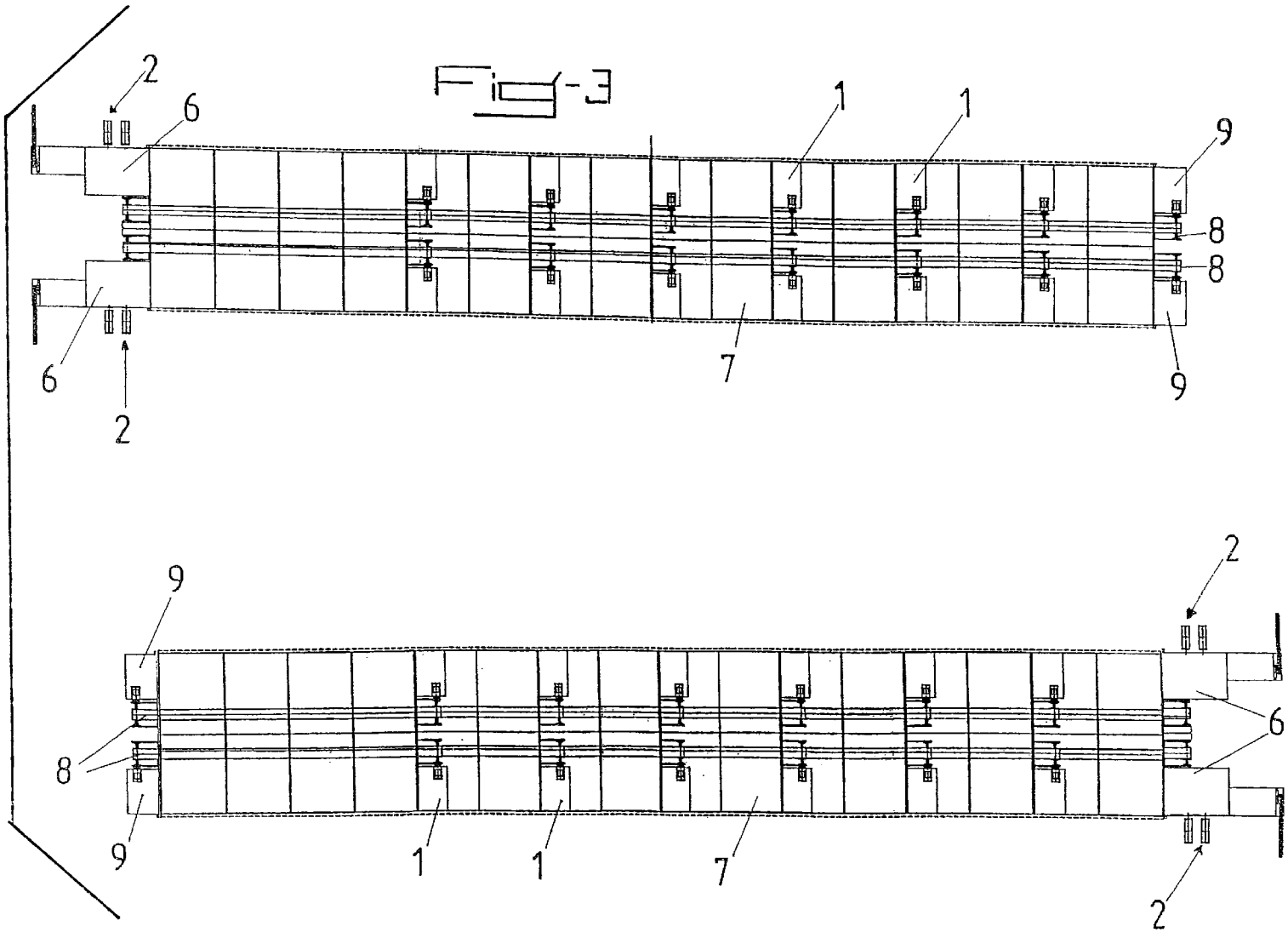
FIG. 3 is a view analogous to that of FIG. 1, showing two assemblies of winding machines mounted back-to-back with respectively a feed from the left and a feed from the right.

FIGS. 1 to 3 of the accompanying drawings show, by way of example, winding machines disposed back-to-back and essentially constituted each by individual winding stations 1 dispose stagewise and which are controlled, at the level of each stage, by an assembly of drive shafts for packages and shafts for driving fliers, the yarns being supplied by means of a pre-feed device 2 for yarns. In the embodiments shown, the winding machines mounted back-to-back are left and right winding machines, which is to say whose supply takes place from the right or from the left relative to the front surface of the machine, as shown in FIG. 2 of the drawings.

The assembly of drive means of each winding machine, consisting in motors 3 to 5 driving assemblies of drive shafts for packages and of the drive shafts of fliers, as well as the pre-feed device 2 for the yarns, as well as the devices for corresponding monitoring and control are disposed in at least one command and control box 6, forming an operating device and mounted at one end of the chassis 7 of the winding machine, which is moreover provided with a conveyor 8 for evacuating packages driven by a corresponding motor 9.

According to the invention, each winding machine is transformable on site and the command and control box 6 for operating the drive means of the drive shafts for packages, the drive shafts for the fliers, and the device 2 for pre-feeding the yarns, can be mounted any way desired, interchangeably, at its two ends, by means of symmetrical end plates 11 or flanges, with arrangement in front of the conveyor 8, which passes through them. Simultaneously, the drive motor 9 for the conveyor 8 for evacuating packages can be mounted, also interchangeably, on the side opposite that of the command and control box 6 (FIGS. 1 to 3). As a result, the conveyor 8 can pass through and be accessible from the two ends of the machine.

It is also possible, according to a modified embodiment of the invention not shown in the accompanying drawings, to integrate the drive motor 9 for the conveyor 8 for evacuating the packages, into the chassis 7 of the machine and to control its traction of driving by means of a reverser.

According to one characteristic of the invention, in the case of the command and control box 6 in several boxes, it is possible to distribute these boxes at the two ends of the chassis 7, preferably on the front side opposite that comprising including the conveyor 8.

Thus it is possible, on the one hand, to provide a back-to-back mounting of two winding machines, as shown in FIGS. 1 to 3 of the accompanying drawings, whilst permitting an evacuation of the packages from the two winding machines on a same side of an assembly of winding machines and, on the other hand, to provide a modification of the side for supplying yarns and/or for the removal of packages (FIG. 3) without requiring delicate intervention of placement of the machines or complicated mounting of the return means. Thus, in such a case, it suffices, from the embodiment according to FIG. 1 or according to the lower portion of FIG. 3, in which two machines disposed back-to-back are supplied from the right and deliver preferably the packages to the left, to disassemble, on the one hand, each command and control box 6 from the corresponding end plate or flange, and, on the other hand, each drive motor 9 of the evacuation conveyor 8 for the packages, also from the corresponding end plate or flange, then to mount them respectively on the opposite ends. There results a mounting according to the upper portion of FIG. 3, in which the supply of yarn is carried out from the left and evacuation of the packages from the right.

According to one characteristic of the invention, the command and control box 6 for operating the drive means of the drive shafts for packages, of the drive shafts for the fliers, and of the pre-feeding device 2 for the yarns, is preferably essentially constituted by independent motors 3 to 5 for driving the assemblies of drive shafts for packages and shafts for driving the fliers, as well as the pre-feed device 2 for the yarns, the control of these motors 3 to 5 being ensured by means of an electronic device.

Such an electronic control device is preferably constituted by a programmable computer assembly by means of a control panel with a graphic terminal or tactile screen, this computer assembly being connected to electronic variators connected to the motors 3 to 5 for driving the assemblies of drive shafts for packages and drive shafts for fliers, as well as of the pre-feed device 2 for the yarns and acting on the regime of these latter, in a continuous manner, as a function of control signals emitted by the computer assembly. Thus, it is possible to drive simultaneously and in synchronism the shafts of the packages and for driving the fliers and the pre-feed device 2 for the yarns, these shafts being subject continuously to variable speeds, so as to carry out a continuous modification of the angle of crossing of the yarns, during their winding on the packages.

The provision of the command and control box 6 according to the invention permits miniaturization of the drive motors 3 to 5, as well as a simplification of their mechanical connection means to the shafts of the packages and for driving the fliers and to the pre-feed device 2 for the yarns, such that the box 6 is relatively compact.

According to another characteristic of the invention, the pre-feed device 2 for the yarns is preferably subdivided into a number of sub-devices 2' for pre-feeding, equal in number to the stages of the winding machine, these sub-devices being connected by a common mechanical drive to the corresponding drive motor 5. In the embodiment shown in FIG. 2 of the accompanying drawings, three sub-devices 2' for pre-feed are provided and assigned each to a stage of the winding machine, such that the layers of yarns to be distributed by each sub-device 2' for pre-feeding, are of a width substantially less than in the case of a single pre-feed device, whose layer of yarns is subdivided in the direction of the different stages to be supplied by means of simple return cylinders.

It is also possible, according to a modified embodiment of the invention not shown in the accompanying drawings, to provide a specific drive motor for each sub-device 2' for pre-feeding.

Similarly, there can be provided a specific motor per stage for each line of shafts or packages and drive shafts of the fliers. Thus, it is possible to provide a winding machine whose stages are asynchronous among themselves and synchronous per stage.

The motors 3 to 5 are respectively connected, by means of simple mechanical transmissions such as pulleys and belts or gearing, to the different lines of shafts and to the pre-feed device 2. As a result, the corresponding mechanical mounting can be carried out in a compact manner, such that the volume of the assembly of the operating device 6 thus constituted can be substantially reduced relative to existing devices of this type. Thus, as shown in FIGS. 1 and 3 of the accompanying drawings, an evacuation of the full packages and access to the conveyors 8 are made possible by the two ends of two machines disposed back-to-back.

According to a modified embodiment of the invention, not shown in the accompanying drawings, it is also possible to mount the motors 9 for driving the conveyors 8 in the command and control box 6. Thus, the operations of disassembly and mounting necessary during a modification of installation or the like, are further reduced and hence accelerated.

It is also possible, according to another modification of the invention, not shown in the accompanying drawings, to carry out a central mounting of the assembly of the command and control box 6 between chassis modules 7 of a predetermined number of spindles, the yarn feed being then carried out in a central manner from above the machine and the removal of the full packages taking place at one or the other end by simple reversal of the drive motor 9 of the conveyor 8.

Thanks to the invention, it is possible to provide a winding machine that can be easily transformed in situ for adaptation to particular working conditions, namely, the supply of yarns and/or the evacuation of full packages.

Moreover, such winding machines permit evacuation of the packages equally well to the right or the left, as well as operation from one or the other of its ends. Similarly, these winding machines can have asynchronous operation from one stage to the other.

Finally, because of the possibility of reversal of the operating device, the back-to-back mounting of the left and right winding machines permits a substantial reduction of the area occupied by such machines.

Of course, the invention is not limited to the embodiment described and shown in the accompanying drawings. Modifications remain possible, particularly as to the construction of the various elements or by substitution of technical equivalents, without thereby departing from the scope of the protection of the invention.

What is claimed is:

1. A winding machine comprising:

plural winding stations arranged in a row that has first and second ends, each of said stations receiving yarn and outputting packages of wound yarn;

a movable command and control box having a pre-feed device for yarn, at least one motor for driving said plural winding stations, and a controller for said pre-feed device and at least one motor, said box being at either of said first and second ends;

a conveyor spanning said plural winding stations and receiving the packages from said stations and delivering the packages to one of said first and second ends; and an end plate at each of said first and second ends, each said end plate having an opening through which said conveyor extends, and each said end plate being arranged and adapted to receive said command and control box so that said command and control box is movable to either of said first and second ends.

2. The winding machine of claim 1, further comprising a movable motor for said conveyor, each said end plate being arranged and adapted to receive said motor so that said motor is movable to one of said first and second ends opposite said end with said command and control box.

3. The winding machine of claim 2, wherein said movable motor is reversible.

4. The winding machine of claim 1, wherein said row has a front and a back, and wherein said command and control box is received on said end plate next to said opening and closer to the front than said opening.

5. The winding machine of claim 1, wherein said row has a front and a back, the machine further comprising, a second row of plural winding stations that has third and fourth ends and a front and back, said third and fourth ends being directly adjacent to respective ones of said first and second ends with the back of said row facing the back of said second row, a second movable command and control box at a one said third and fourth ends that is directly adjacent to a one of said first and second ends having said command and control box, a second conveyor spanning said second row and delivering further packages of wound yarn to a one of said third and fourth ends that is directly adjacent to a one of said first and second ends to which the packages are delivered, and a further end plate at each of said third and fourth ends, each said further end plate having an opening through which said second conveyor extends, and each said further end plate being arranged and adapted to receive said second command and control box so that said second command and control box is movable to either of said third and fourth ends.

6. The winding machine of claim 1, wherein said pre-feed device for yarn comprises plural sub-devices.

* * * * *